US005975358A

United States Patent [19]

Zheng et al.

[11] Patent Number: 5,975,358

[45] Date of Patent: Nov. 2, 1999

[54] TOY GUN WITH AN INTEGRATED TARGET GENERATOR

[75] Inventors: Yu Zheng, Covina; Yu-Bing Xia, Monterey Park; Zheng Liu, Rowland Heights, all of Calif.

[73] Assignee: Patent Category Corp, Walnut, Calif.

[21] Appl. No.: 09/074,898

[22] Filed: May 8, 1998

[51] Int. Cl.[6] ..... A63H 33/28

[52] U.S. Cl. ..... 222/79; 446/15

[58] Field of Search ..... 222/79, 190; 446/15

[56] References Cited

U.S. PATENT DOCUMENTS

| | | | |
|---|---|---|---|
| Re. 35,412 | 12/1996 | Johnson et al. . | |
| 2,518,627 | 8/1950 | Lorenz | 446/15 |
| 2,974,438 | 3/1961 | Hopkins | 446/15 |
| 3,389,492 | 6/1968 | Sullivan et al. | 222/79 |
| 3,636,652 | 1/1972 | Dumont | 446/15 |
| 4,334,383 | 6/1982 | Melotti | 222/79 |
| 5,234,129 | 8/1993 | Lau | 222/79 |
| 5,339,987 | 8/1994 | D'Andrade . | |

*Primary Examiner*—Andres Kashnikow
*Assistant Examiner*—David Deal
*Attorney, Agent, or Firm*—Raymond Sun

[57] ABSTRACT

A toy gun with an integrated target generator is disclosed. A water container is provided to store water and to provide pressurized water as ammunition for the water gun. A bubble generator assembly is provided to generate bubbles that can be used as targets for the water gun. A pump handle is provided to pump air into the water container and to simultaneously actuate the bubble generator assembly. A trigger assembly is provided to allow a user to selectively fire water out of the water gun.

19 Claims, 14 Drawing Sheets

TOY GUN WITH AN INTEGRATED TARGET GENERATOR

BACKGROUND OF THE INVENTION

1. Field of the Invention

The present invention relates to toy guns, and in particular, to a toy gun with an integrated target generator. In the present invention, the target generator is provided in the form of a bubble generator that generates bubbles, and the toy gun ejects water that can be directed at the generated bubbles.

2. Description of the Prior Art

Toy guns are very popular among children. Presently-available toy guns can be adapted to fire a wide variety of soft or non-harmful ammunitions ranging from water to foam darts. For example, toy water guns have been provided for the entertainment of children for a long time. Many conventional water guns include (1) a trigger that can be actuated to fire water from the water gun, (2) a water container for holding the water, and (3) a pump mechanism used to pressurize the water in the water container. To use the water gun, a user fills the water container with water. The user then pumps the pump mechanism to pressurize the water in the water container. Next, the user aims the water gun at a target and actuates the trigger that effects the release of pressurized water out of the water gun.

Unfortunately, these conventional toy guns are not provided with any targets. Consequently, the ammunitions (foam darts, water) in these toy guns are often fired at certain undesirable targets, such as furniture, windows, walls, animals or other people. This lack of targets is undesirable for several reasons. First, even though the ammunitions (water, foam darts, etc.) are chosen to be relatively harmless, they can deface walls and furnitures, damage paintings or other precious art objects, create a mess around the house, and possibly damage windows. Second, these ammunitions can be dangerous. For example, the water fired from a toy water gun is pressurized, and the pressurized water or foam darts could hit a person in the eyes or in the ears. This risk of injury cannot be discounted since these toy guns are usually operated by children of all ages, including younger children who may not always carefully evaluate the consequences of their actions before acting. Moreover, as the distance to the target decreases, the risk of injury to the person increases.

In addition, children demand variety in their play things, and many children have grown tired of shooting at stationary objects. Many children are now demanding toys, and in particular, toy guns, that are different and which offer more excitement, greater sophistication of play, and more options.

In addition, to meet the demand for more exciting and sophisticated toys, the construction of many toys have unfortunately become more complex and therefore more expensive.

Accordingly, there remains a need for an improved toy gun that address the disadvantages set forth previously and that is cost-effective to manufacture.

SUMMARY OF THE DISCLOSURE

It is an object of the present invention to provide a toy gun that offers more exciting play than the presently available toy guns, but which has a simple construction.

It is another object of the present invention to provide a toy gun that is capable of generating targets that can be fired at.

It is yet another object of the present invention to provide a toy water gun that has an integrated bubble generator for generating bubbles, which can then be targeted by the water gun.

It is a further object of the present invention to provide a toy water gun with a pump handle that both pressurizes the water container and also activates the bubble generator.

It is yet a further object of the present invention to provide an improved water gun that allows for a novel method of play where one first generates bubble targets and then employs the water gun to shoot the bubble targets.

In order to accomplish the objects of the present invention, a toy water gun having an integrated bubble generator is provided. A water container is provided to store water and to provide pressurized water as ammunition for the water gun. A trigger assembly is provided to allow a user to selectively fire water out of the water gun. A bubble generator assembly is provided to generate bubbles that can be used as targets for the water gun. A pump handle is provided to pump air to pressurize water in the water container and to simultaneously actuate the bubble generator assembly.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1A:
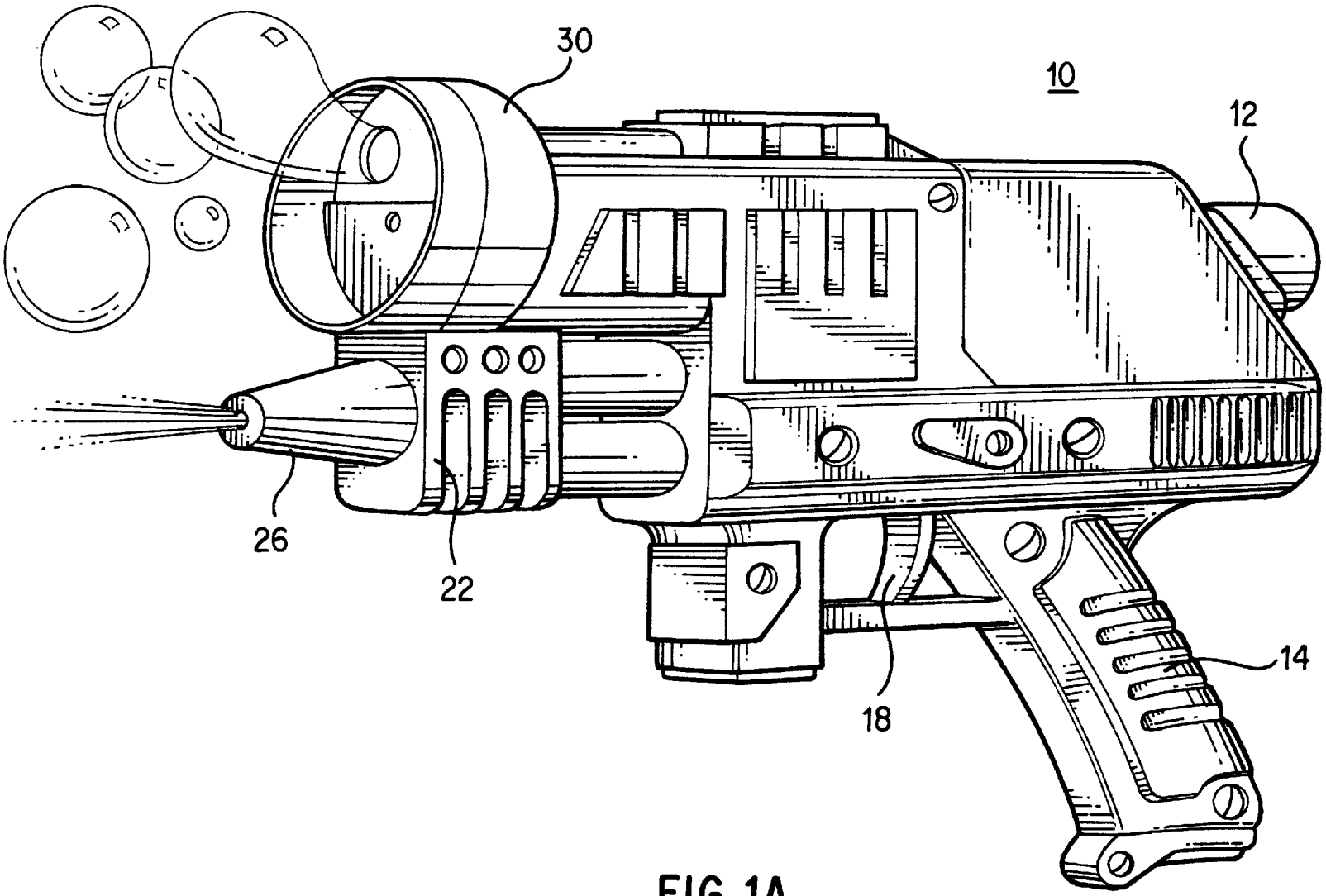
FIG. 1A is a perspective view of a toy water gun according to one embodiment of the present invention.
Figure 1B:
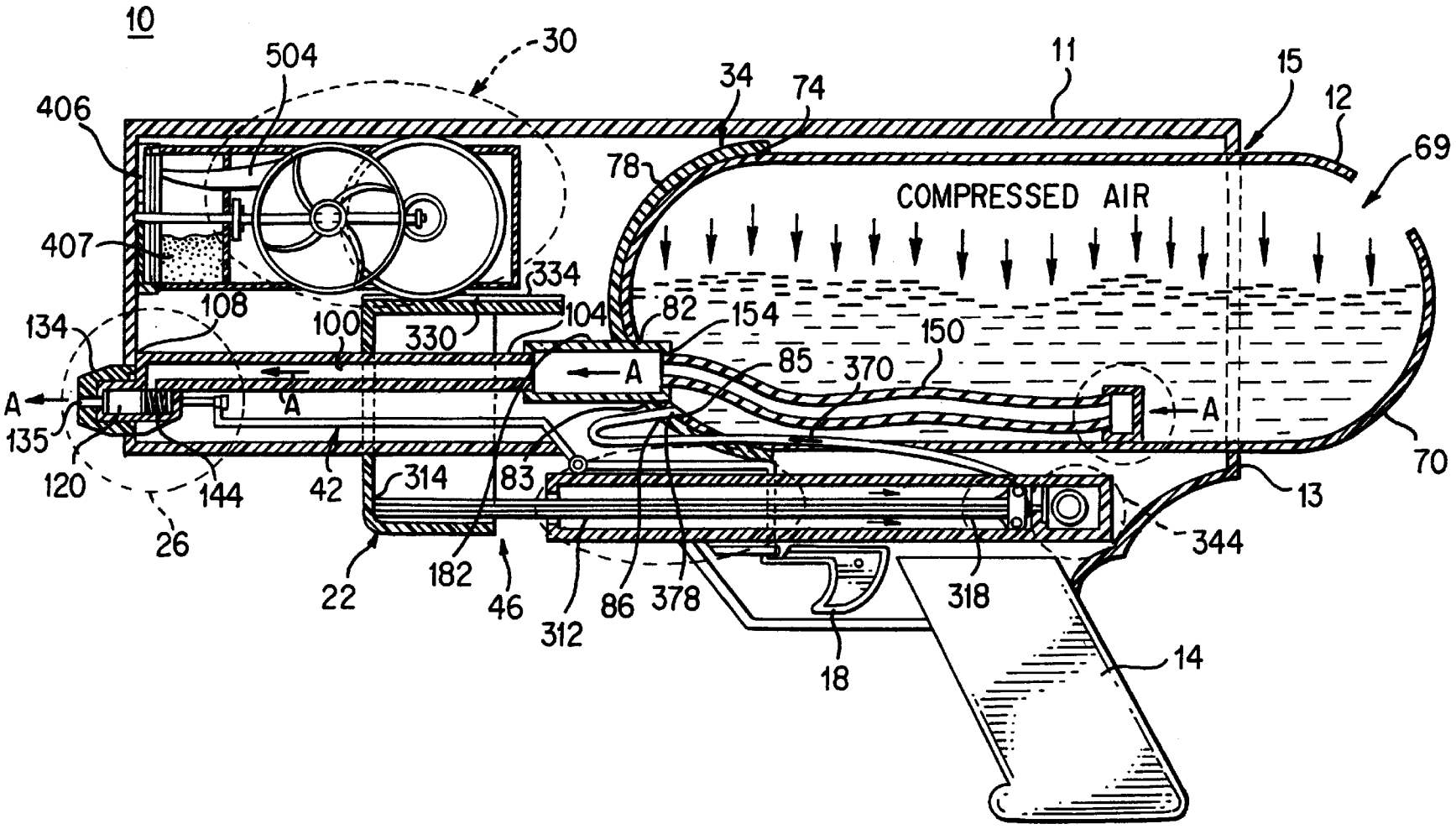
FIG. 1B is a cross-sectional side plan view of the toy water gun of FIG. 1A.

Referring to FIG. 1A, the toy water gun 10 according to one embodiment of the present invention has a left half or housing and a right half or housing that are combined together to form the toy water gun 10. The right half or housing 11 of the toy water gun 10 and the different assemblies housed therein are illustrated in FIG. 1B. The left housing is the same as the right housing and will not be described. The left and right housings 11 of the toy water gun 10 are connected together by means of screws, glue, rivets, fasteners and other conventional connecting mechanisms.

The right and left housings 11 of the water gun 10 include a back wall 13 that forms an opening 15 for receiving a water container 12. The water gun 10 also includes a handle 14 that is adapted to be gripped by the user, and a trigger 18 that is adapted to be pressed by a user's finger to selectively fire water from the water gun 10. The trigger 18 is a component of a trigger assembly, which is described hereinafter with respect to FIG. 3D. The water gun 10 includes a pump handle 22 that is slidably mounted on a barrel portion of the water gun 10, and which is adapted to both pressurize the water inside the water container 12 and to actuate a bubble generator assembly 30, as described below. The pump handle 22 is a component of an air pump assembly, which is described hereinafter with respect to FIGS. 4A–4E.

The water gun 10 further includes a nozzle assembly 26, which is described in greater detail hereinafter in connection with FIG. 3A. The water gun 10 includes an integrated bubble generator assembly 30 having a receptacle for storing bubble solution. A user actuates the bubble generator assembly 30 by employing the pump handle 22.

The basic operation or mode of play of the water gun 10 is as follows. To prepare the water gun 10 for play, the user fills the water container 12 with water, and fills the receptacle of bubble generator assembly 30 with bubble solution. The user then pumps the pump handle 22 to pressurize the water container 12 and to simultaneously actuate the bubble generator assembly 30, causing the bubble generator assembly 30 to generate bubbles. Next, the user aims the water gun 10 at a target, such as the generated bubbles, and shoots water at the target by pressing the trigger 18 to release pressurized water through the nozzle assembly 26.

Referring to FIG. 1B, the right and left housings 11 of the improved water gun 10 of the present invention house the following assemblies: (1) a water conduit assembly 34 that includes nozzle assembly 26; (2) a trigger assembly 42; (3) an air pump assembly 46; and (4) a bubble generation assembly 30.

1. Water Conduit Assembly 34

Referring to FIG. 1B, the water conduit assembly 34 is housed inside the housing 11 and extends through the opening 15 in the back wall 13. The water conduit assembly 34 includes a water container 12 that stores water. An inlet 69 is provided at the rear of the water container 12 to allow the user to introduce water into the water container 12. The container 12 has a body 70 and a front portion 74 that is provided with an opening 82. A cap 78 is attached to the front portion 74, either through a threaded engagement or welding or other conventional mechanical connection. The cap 78 defines a first opening 83 that is aligned with and communicates with opening 82 for providing pressurized water therethrough to nozzle assembly 26, and a second opening 86 for receiving air therethrough from the air pump assembly 46. The second opening 86 communicates with another opening 85 in the water container 12. Second opening 86 of cap 78 can receive an air valve (not shown) that is can be optionally coupled to an air tube 370, which is described in greater detail hereinafter in connection with air pump assembly 46. The water conduit assembly 34 also includes an upper conduit 100 having a first end 104 coupled to the first opening 83 of the cap 78 and a second end 108.

Figure 3B:
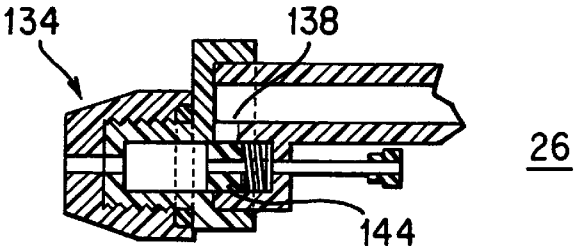
FIG. 3B is a cross-sectional side plan view of the nozzle assembly of FIG. 3A illustrating a closed nozzle assembly.
Figure 3C:
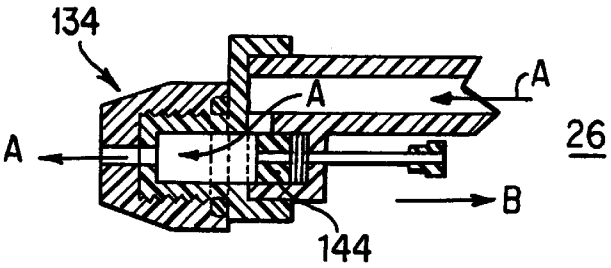
FIG. 3C is a cross-sectional side plan view of the nozzle assembly of FIG. 3A illustrating an open nozzle assembly.

The water conduit assembly 34 further includes a nozzle assembly 26. Referring to FIGS. 3A–3C, nozzle assembly 26 includes a portion of the upper conduit 100 adjacent the second end 108. The nozzle assembly 26 further includes a lower conduit 120 having a first end 124 and a second end 128, with the first end 124 fluidly coupled to the second end 108 of upper conduit 100. Upper conduit 100 and lower conduit 120 can be provided in one piece in the form of tubes made of a substantially rigid material such as plastic. The nozzle assembly 26 further includes a nozzle head 134 that is disposed distal to second end 128 of lower conduit 120 for providing a channel 135 for pressurized water to be released from nozzle assembly 26. The nozzle head 134 has an internal bore 136 having internal threads 137 that threadably engage external threads 139 provided on the external cylindrical surface of the lower conduit 120. A gasket or O-ring 140 can be positioned inside the bore 136 and over the external threads 139 to provide a seal at the threaded connection between the lower conduit 120 and the nozzle head 134.

A passageway 138 is provided between the upper conduit 100 and lower conduit 120 to communicate pressurized water from the water container 12 through the upper conduit 100 and into the lower conduit 120. A stopper 144 is disposed in the lower conduit 120 to selectively block the passageway 138. The stopper 144 can be made from a non-water permeable material, such as rubber.

Referring to FIG. 3B, when the stopper 144 is in a first position (i.e, a closed position) blocking the passageway 138, water cannot enter lower conduit 120 from upper conduit 100. Referring to FIG. 3C, when the stopper 144 is in a second position (i.e., an open position) in which it has been retracted proximally from the first position, the passageway 138 is opened to allow water to enter the lower conduit 120 from the upper conduit 100, and to exit the water gun 10 via the channel 135. The stopper 144 is coupled to a stopper release arm 148, which is described in greater detail hereinafter with reference to the trigger assembly 42.

Figure 2B:
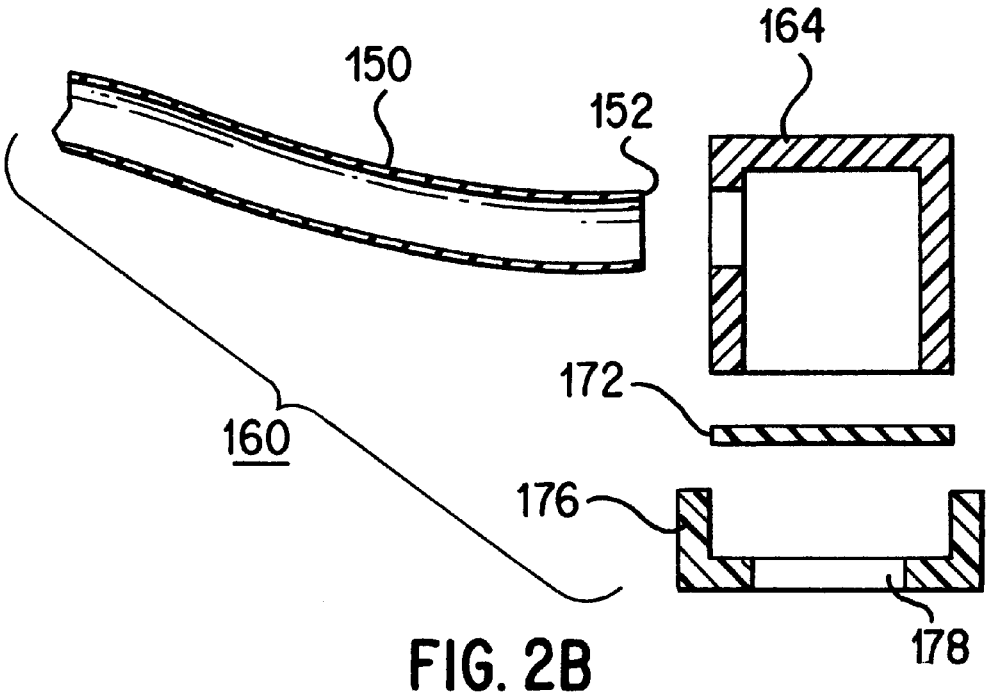
FIG. 2B is an exploded cross-sectional side plan view of FIG. 2A.
Figure 2A:
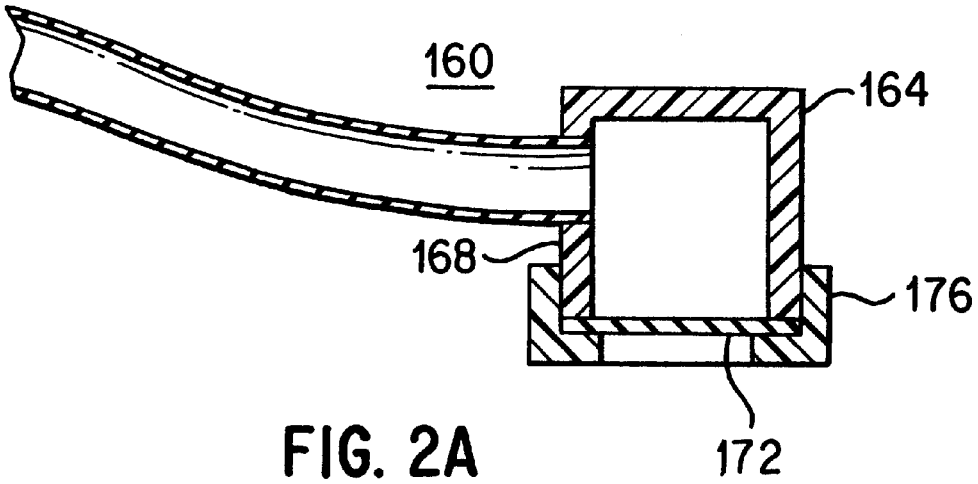
FIG. 2A is a cross-sectional side plan view illustrating in greater detail one aspect of the water conduit assembly of FIG. 1B.

Referring now to FIGS. 2A and 2B, a water tube 150 is provided to transport water from water container 12 to the upper conduit 100. The water tube 150 includes a first end 152 that is disposed in water container 12 and a second end 154 (see FIG. 1B) that is coupled to the first end 104 of upper conduit 100. A filter assembly 160 is coupled to the first end 152 of the water tube 150 to prevent debris and other particles from entering the water tube 150 and thereby clogging the water conduit assembly 34. The filter assembly 160 has a body 164 having a side wall 168 that defines an opening for receiving the first end 152 of water tube 150. The filter assembly 160 also includes a mesh 172 that is coupled between the body 164 and a cap 176 for filtering particles. The cap 176 defines an opening 178 for allowing fluid communication with the interior of the body 164.

A tubular member 182 is provided or otherwise secured in the first opening 83 of the cap 78 through the cap 78. The water tube 150 extends through the tubular member 182 and the inner lumen of the water tube 150 communicates with the inner lumen of the upper conduit 100. Tubular member 182 can be made of a substantially rigid material such as plastic.

Thus, pressurized water travels from water container 12 through the water conduit assembly 34 and the nozzle head 134 following a path indicated by the arrows that are denoted by the letter "A" in FIGS. 1B, 3B and 3C.

2. Trigger Assembly 42

Figure 3A:
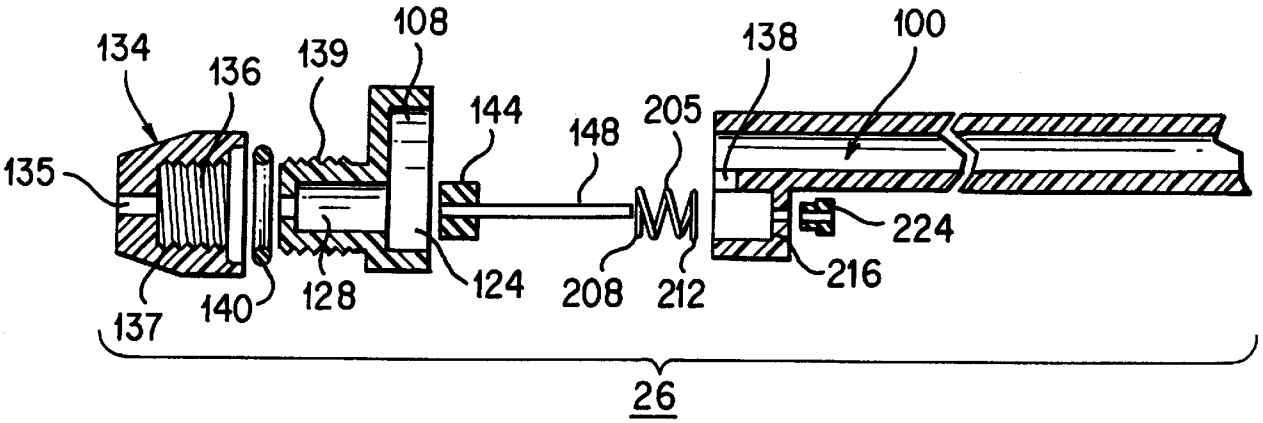
FIG. 3A is an exploded cross-sectional side plan view illustrating in greater detail the nozzle assembly of FIG. 1B.
Figure 3D:
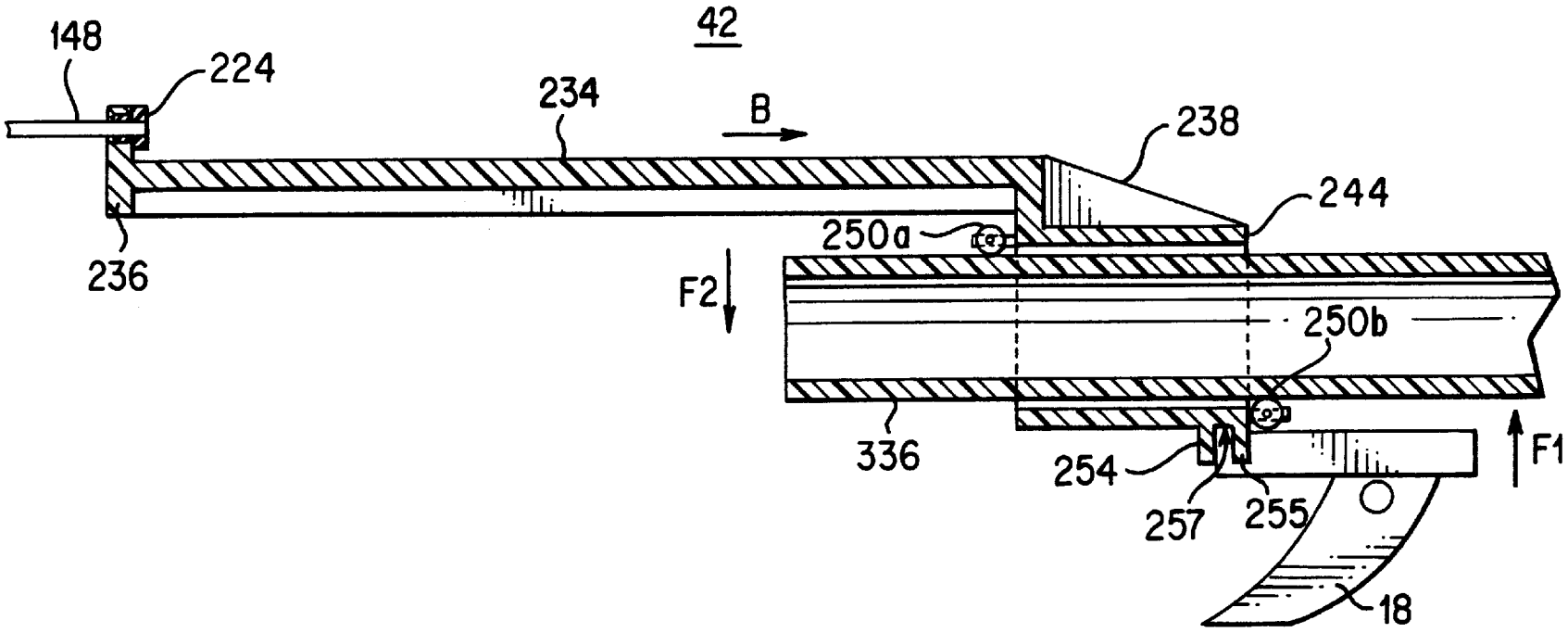
FIG. 3D is a cross-sectional side plan view illustrating in greater detail a portion of the trigger assembly of FIG. 1B.

The trigger assembly 42 is illustrated in greater detail in FIGS. 1B, 3A and 3D. All of the components of the trigger assembly 42 (except the trigger 18) are also housed inside the housing 11.

As noted earlier in connection with FIG. 3A, a stopper release arm 148 is coupled to the stopper 144. A spring 205 is provided to normally bias the stopper 144 towards the nozzle assembly 134 into the first (closed) position, thereby blocking the passageway 138. Spring 205 includes a first end 208 for engaging the stopper 144 and a second end 212 for engaging a back wall 216 of lower conduit 120. The spring 205 can be provided in the form of coiled springs, or resilient elongated strips of material, or other similar mechanisms. The stopper release arm 148 is secured to the back wall 216 by a stop member 224 that can be journaled or otherwise secured to the back wall 216.

As will be explained hereinafter, when a user presses trigger 18, stopper release arm 148 pulls stopper 144 against the normal bias of spring 205, causing the stopper release arm 148 to move in the direction indicated by the arrow denoted "B" in FIG. 3C. Accordingly, the stopper 144 is moved into the open position, thereby allowing water to enter the lower conduit 120 from upper conduit 100.

Referring to FIGS. 3A and 3D, the trigger assembly 42 includes a pull arm 234 having a first end 236 that is fixably coupled to stopper release arm 148 and a second end 238 that forms a generally cylindrical connection piece 244. Connection piece 244 is slidably mounted over a piston receiving portion 336 so that a portion of the piston receiving portion 336 is retained inside the interior of the connection piece 244. A pair of diagonally-opposed wheels 250*a* and 250*b* are disposed at opposite ends of the connection piece 244. A pair of protruding walls 254 and 255 extend from the bottom of the connection piece 244 adjacent wheel 250*b* and defines a gap 257 for receiving a portion of the trigger 18.

The operation of the trigger assembly 42 will now be described. When the user presses trigger 18, the trigger's 18 engagement with the walls 254 and 255 of the connection piece 244 causes the connection piece 244 to slide rearwardly in the direction indicated by the arrow "B" in FIG. 3D. The rearward sliding motion of the connection piece 244 would normally impart an upward force (see arrow F1 in FIG. 3D) that in normal circumstances may cause the rear end of the connection piece 244 to frictionally slide along the piston receiving portion 336. However, the provision of the rear wheel 250*b* eliminates the frictional slide and instead facilitates a smooth sliding motion. Applying similar principles, the rearward sliding motion of the connection piece 244 would impart a downward force (see arrow F2 in FIG. 3D) that in normal circumstances may cause the front end of the connection piece 244 to frictionally slide along the piston receiving portion 336. Therefore, the provision of the front wheel 250*a* eliminates the frictional slide and facilitates a smooth sliding motion.

The rearward sliding motion of the connection piece 244 pulls the pull arm 234 in a proximal direction towards the trigger 18 as indicated by the arrow "B" in FIG. 3D, and thereby causes the stopper release arm 148 to move in the same direction. Since the stopper 144 is coupled to the stopper release arm 148, pressing or pulling the trigger 18 forces the stopper 144 to move into the second (open) position shown in FIG. 3C.

3. Air Pump Assembly 46

The air pump assembly 46 is illustrated in greater detail in FIGS. 1B and 4A–4D. All of the components of the air pump assembly 46 (except the pump handle 22) are also housed inside the housing 11.

Figure 4B:
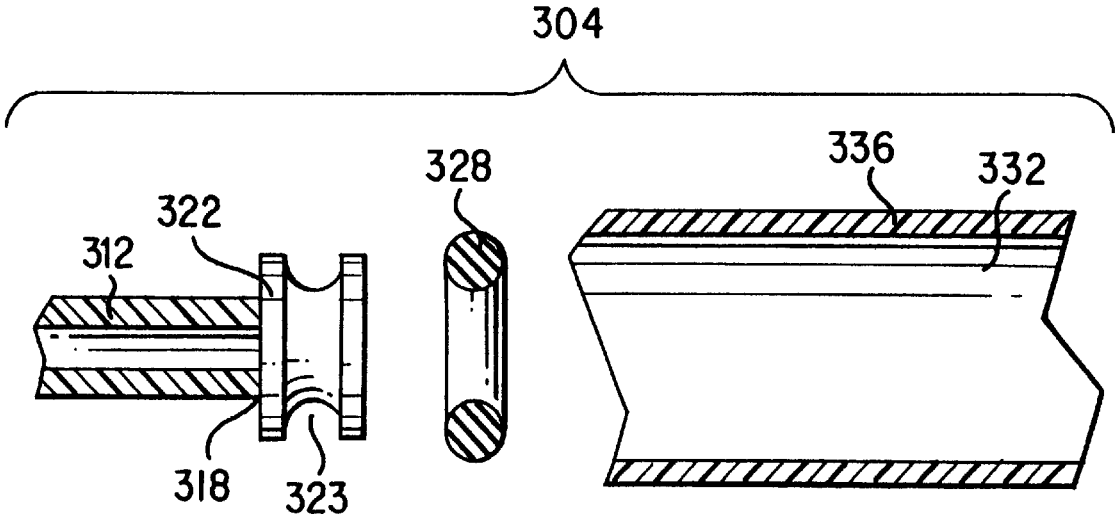
FIG. 4B is an exploded cross-sectional side plan view illustrating in greater detail the portion of the air pump assembly of FIG. 4A.
Figure 4A:
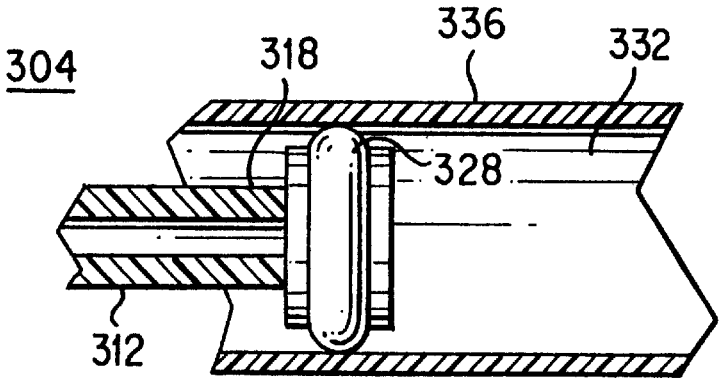
FIG. 4A is a partial cross-sectional side plan view illustrating in greater detail the piston portion of the air pump assembly of FIG. 1B.

Referring to FIGS. 1B, 4A and 4B, the air pump assembly 46 includes a pump handle 22 and a piston rod or plunger 312. The piston 312 includes a first end 314 that is connected to the pump handle 22 and a second end 318 that carries an enlarged end 322 having an annular groove 323 that is adapted to receive a rubber ring 328. The piston 312 and the rubber ring 328 are disposed in a generally cylindrical cavity 332 formed by a piston receiving portion 336. The piston 312 can be moved in a distal direction towards the nozzle assembly 26 or in a proximal direction towards the trigger 18. The ring 328 functions to seal the coupling between the enlarged end 322 and the piston receiving portion 336.

Figure 4D:
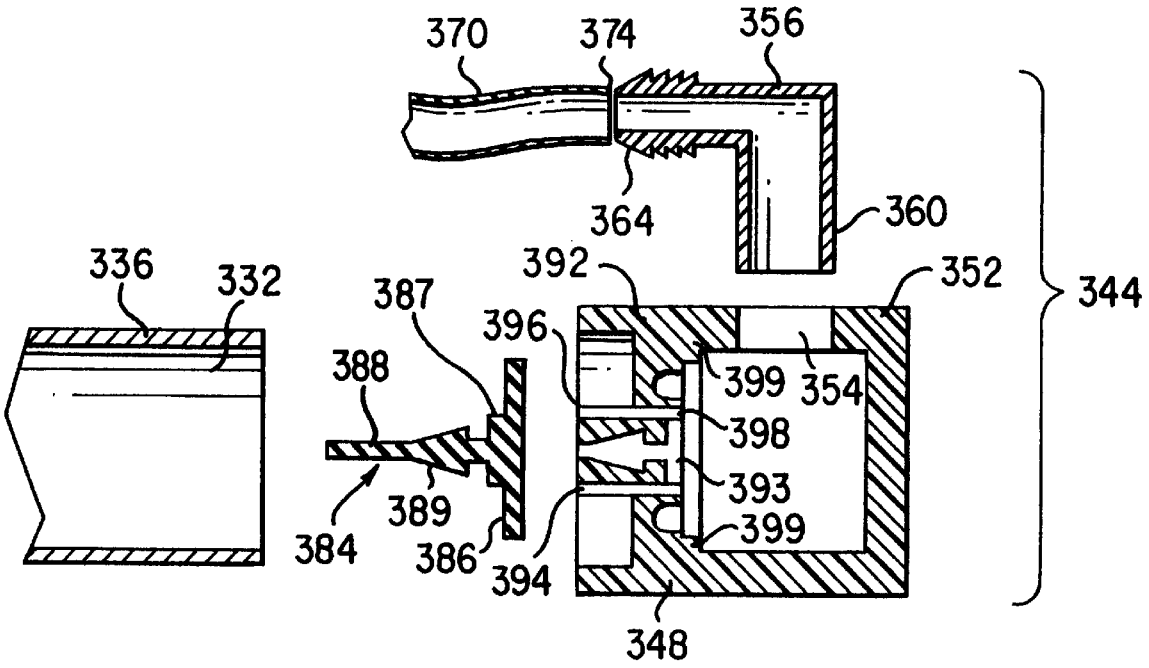
FIG. 4D is an exploded cross-sectional side plan view of FIG. 4C.
Figure 4C:
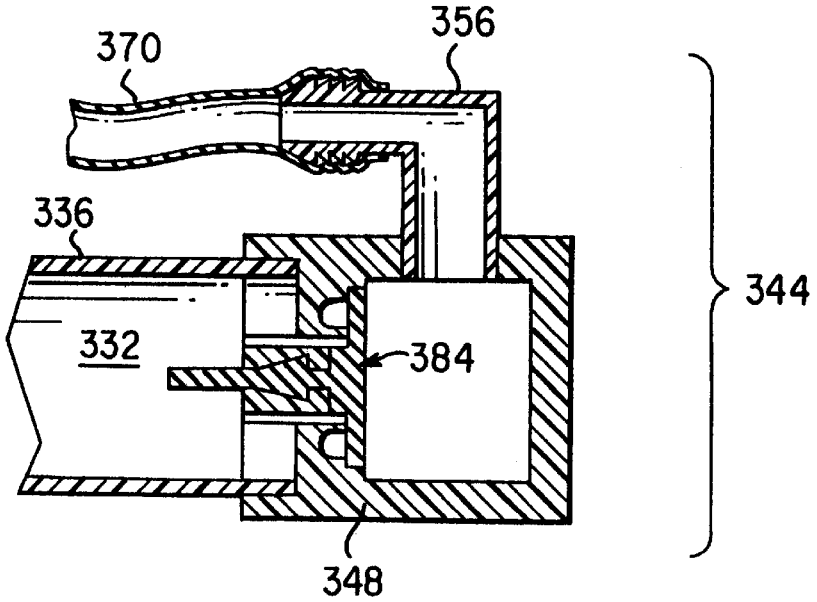
FIG. 4C is a cross-sectional top plan view illustrating in greater detail the valve portion of the air pump assembly of FIG. 1B.

Referring now to FIGS. 4C and 4D, the air pump assembly 46 includes a one-way valve assembly 344. The valve assembly 344 includes a valve housing 348 having a top wall 352 that defines an opening 354. A generally L-shaped connector 356 has a first end 360 that is connected to opening 354 and a second end 364 that is connected to a first end 374 of an air tube 370. The air tube 370 has a second end 378 that is coupled to the second opening 86 of the cap 78 (see FIG. 1B).

The valve assembly 344 includes a one-way valve 384 that is preferably made of rubber. Valve 384 includes a generally circular base portion 386 and a longitudinal portion 388 having a base flange 387 and a triangular flange 389. The housing 348 includes a front portion 392 that defines two air channels 394. Each air channel 394 includes a first end 396 adapted to receive air from cavity 332 and a second end 398 in flow communication with the interior of the valve housing 348. The front portion 392 also defines a central bore 393 that has the same configuration as the longitudinal portion 388, the base flange 387 and the triangular flange 389 of the valve 384. In particular, the front portion 392 includes an annular step 399 that is adapted for receiving the circular base portion 386. Thus, the provision of the flanges 387 and 389 functions to securely position the valve 384 inside the front portion 392 of the valve housing 348, with the circular base portion 386 covering the second end 398 of each air channel 394.

The pump handle 22 may be pulled and pushed back and forth (i.e., reciprocated) to cause the piston 312 to drive air through the valve 384 and into water container 12 via the air tube 370. When air is being forced through the cavity 332 by the piston 312, the flexible nature of the circular base portion 386 causes it to bend inwardly (i.e. into the interior of the valve housing 348) in such a manner as to allow air to pass from the cavity 332 through the air channels 394 into the interior of the valve housing 348. The air is then forced through the air tube 370 into the water container 12. On the other hand, when no air is being forced through the cavity 332 by piston 312, the circular base portion 386 prevents air or water from backing up into cavity 332 from the interior of the valve housing 348 or the air tube 370. In this regard, the annular step 399 provides a stop surface that prevents the circular base portion 386 from bending under the influence of backward pressure, so as to maintain the one-way flow nature of the valve 384.

It is important that the valve 384 be a one-way valve that allows air to exit the cavity 332, but which prevents air and water from returning to the cavity 332 from the valve housing 348 or the air tube 370. Alternatively, or in addition, a one-way valve can be disposed at the second opening 86 of the cap 78 to allow air to enter the water container 12, but to prevent air and water from entering the air tube 370.

Figure 5A:
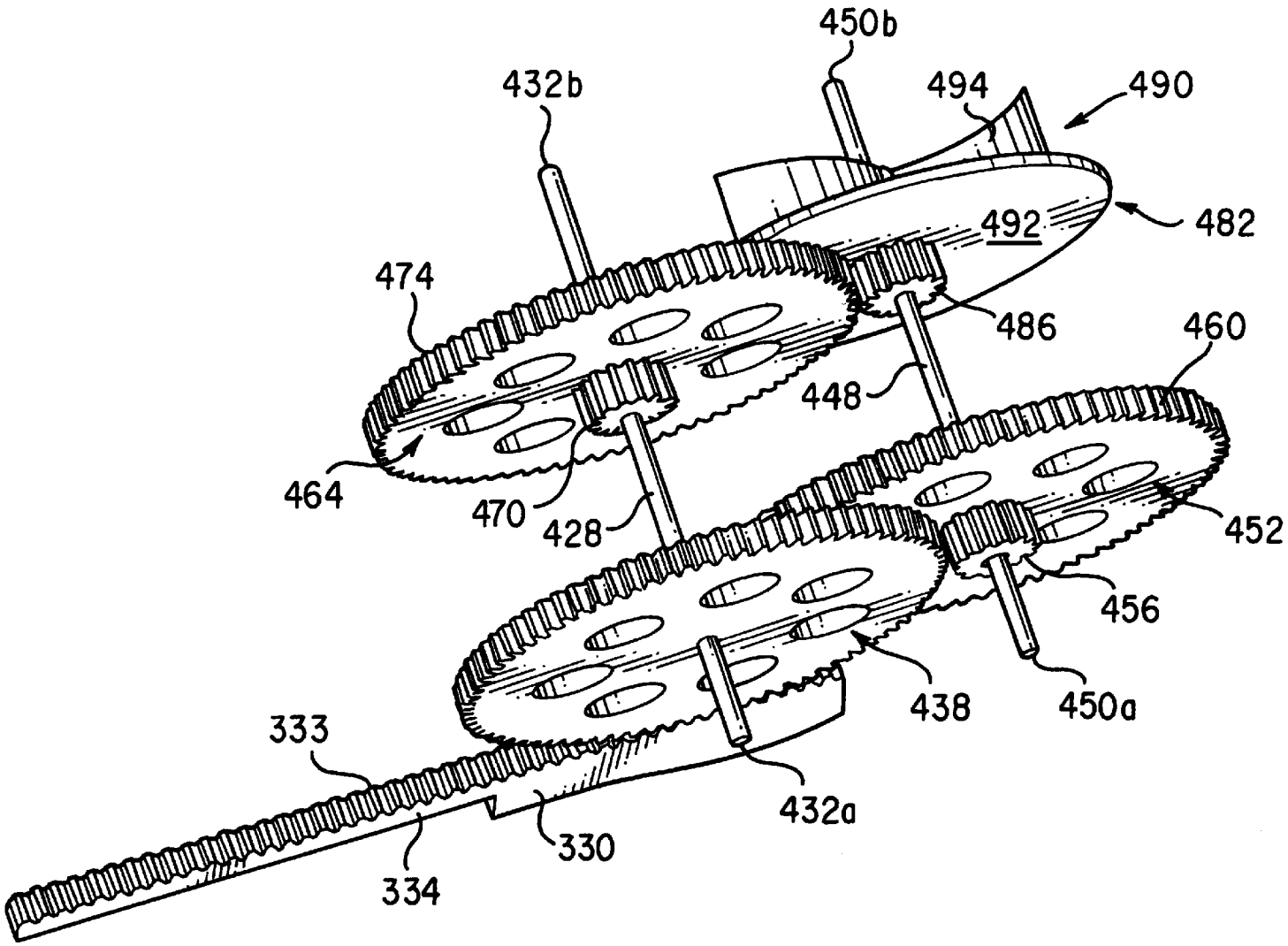
FIG. 5A is an expanded front perspective view of a portion of the bubble generator assembly of FIG. 1B.

Referring now to FIGS. 1B and 5A, the pump handle 22 is provided with a rail 330 that may be formed integrally on the top of the pump handle 22. The rail 330 includes a first surface 334 that defines a plurality of teeth 333 for engaging a first gear 438 of the bubble generator assembly 30, which is described in greater detail hereinafter. As a user employs the pump handle 22 to pump the piston 312, the rail 330 reciprocates in a distal direction towards the nozzle assembly 26 and in a proximal direction towards the trigger 18 to actuate the bubble generator assembly 30, as described in greater detail hereinbelow.

Thus, unlike conventional water guns that employ a pump assembly only to pressurize water container 12, the water gun 10 of the present invention employs the novel pump handle 22 that is reciprocated to simultaneously pressurize the water container 12 and to actuate the bubble generator assembly 30 (via the rails 330), thereby making the water gun 10 simple to use while increasing its play variety. Accordingly, the present invention generates harmless targets (i.e., bubbles) for a user to shoot with the water gun 10.

4. Bubble Generator Assembly 30

Figure 5B:
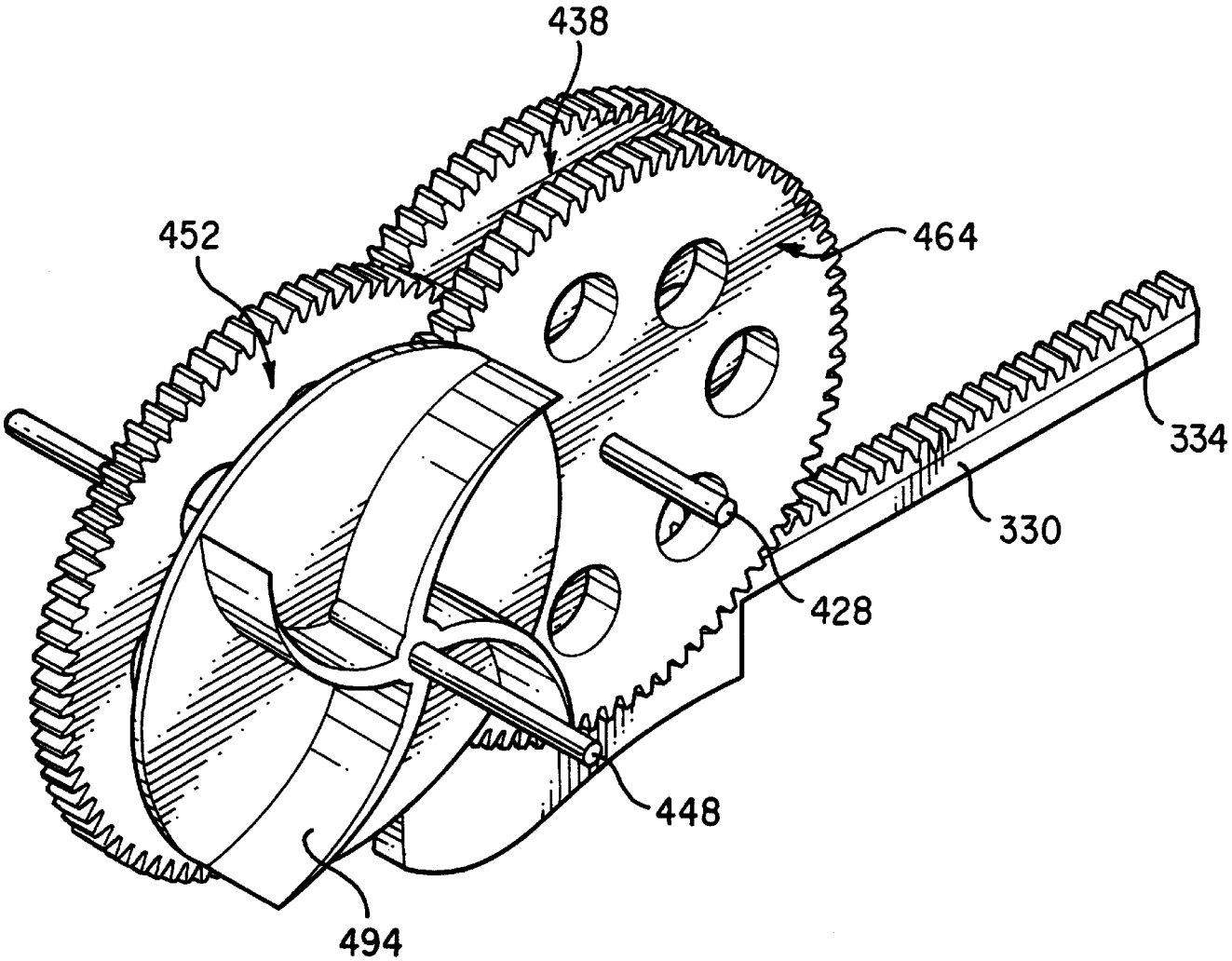
FIG. 5B is a rear perspective view of the portion of the bubble generator assembly of FIG. 5A.
Figure 5C:
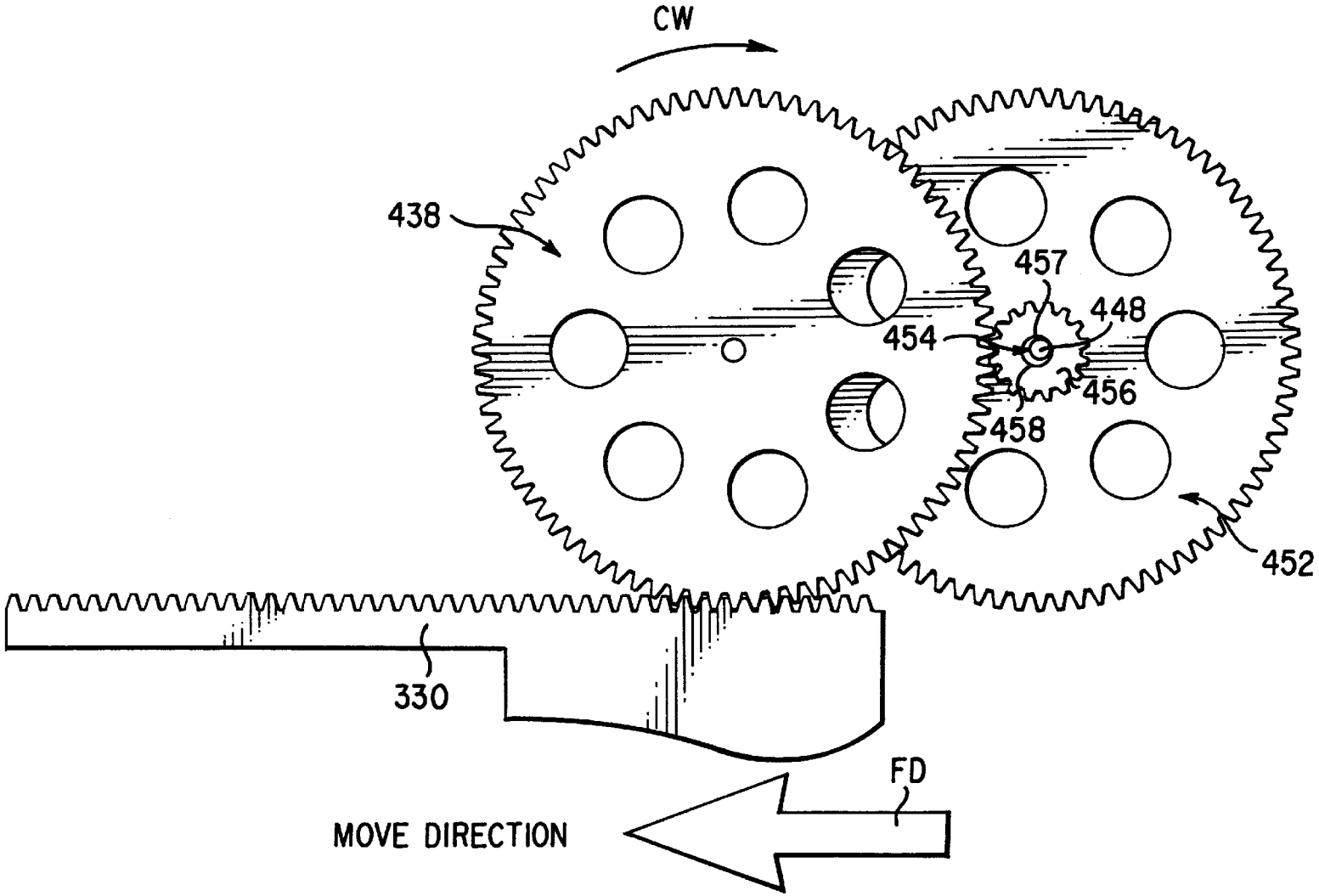
FIG. 5C is a partial side plan view illustrating how the first gear engages the second gear when the pump handle is moving in a first direction.
Figure 5D:
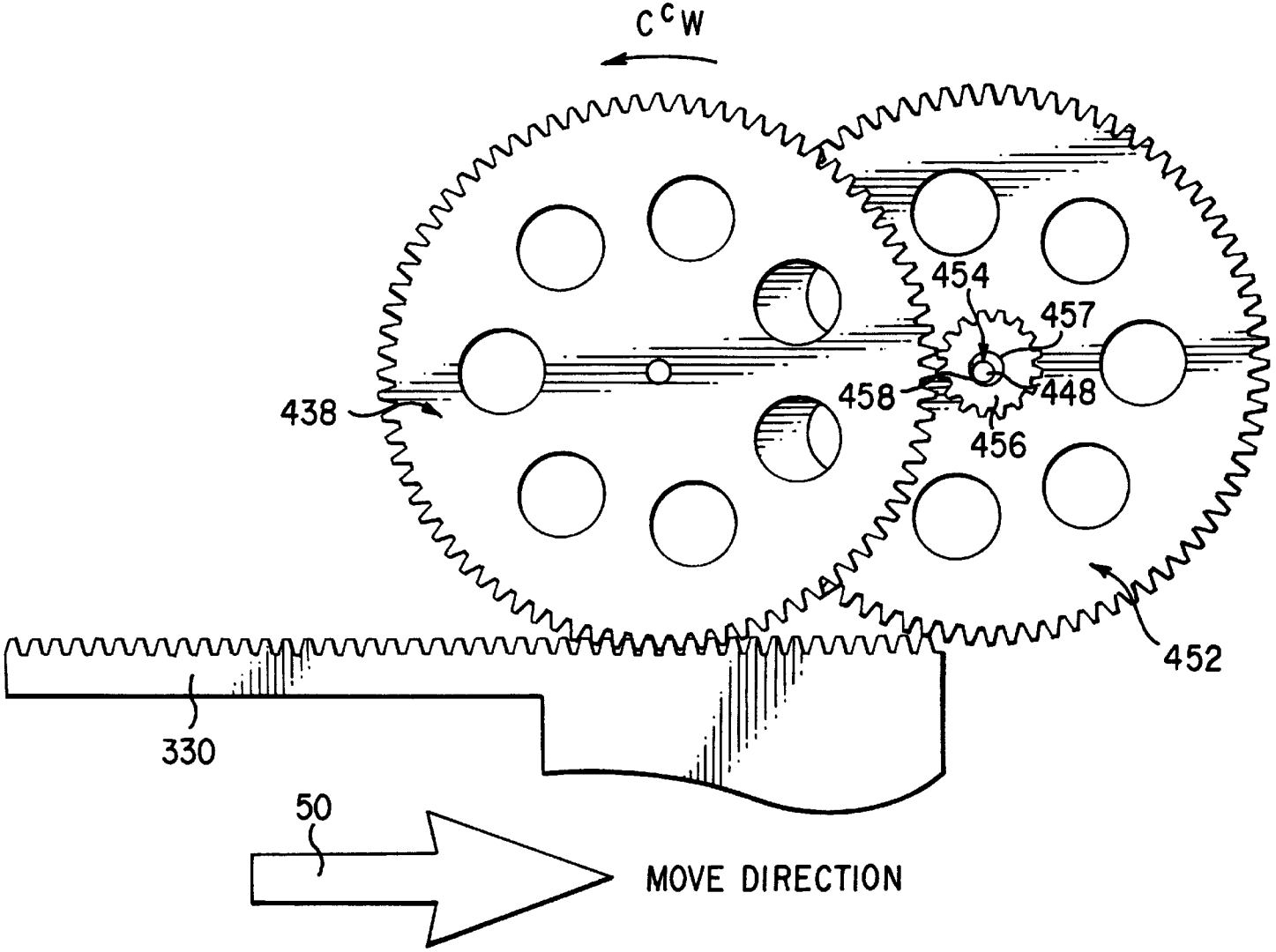
FIG. 5D is a partial side plan view illustrating how the first gear disengages the second gear when the pump handle is moving in a second direction.
Figure 5E:
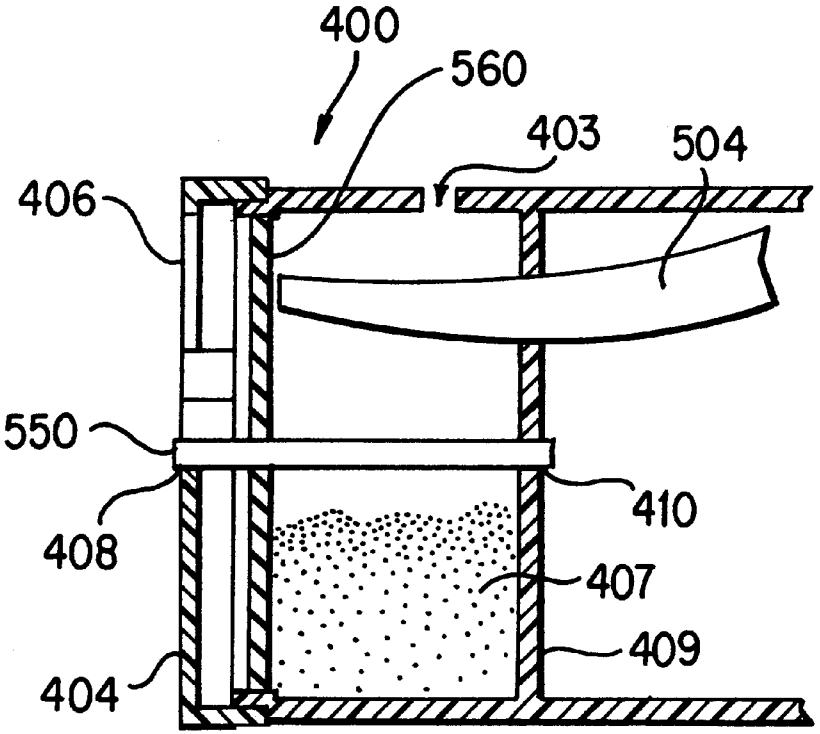
FIG. 5E is a partial cross-sectional side plan view illustrating in greater detail the bubble generator assembly of FIG. 1B.

The bubble generator assembly 30 is also housed inside the housing 11, and is disposed distal of the water container 12 and above the upper conduit 100. Referring to FIGS. 5E and 5G, the bubble generator assembly 30 has a housing 400 having a front wall 404 that has a rod support 408 and which defines an opening 406 for allowing bubbles to be released into the air. Bubble generator assembly 30 further includes a bubble solution container 407 for holding bubble solution. The bubble solution container 407 includes a back wall 409 having a rod support 410. The housing 400 further includes two opposing side walls, a right side wall 412 and a left side wall 416 (only partially shown in FIG. 5G). The right side wall 412 has a first rod support 420*a* and a second rod support 422, and the left side wall 416 has a rod support 420*b*. Each of the above-mentioned rod supports 408, 410, 420*a*, 420*b* and 422 can be provided in the form of journals or holes that receive one end of a rotatable rod. The pump handle 22 is reciprocated to actuate the bubble generator assembly 30 to generate bubbles. To do so, the bubble generator assembly 30 utilizes two gear systems.

The first gear system shall be described first. Referring to FIGS. 5A and 5B, the bubble generator assembly 30 includes a first rod 428 having a first end 432*a* that is rotatably secured to the first rod support 420*a* and a second end 432*b* that is rotatably secured to the second rod support 420*b*. "Rotatably secured" means that the end 432*a* of the rod 428 is secured in the rod support 420*a* in a manner such that the rod 428 can be rotated. A first gear or toothed wheel 438 is fixably mounted on the first rod 428. "Fixably mounted" means that the first gear 438 rotates as the first rod 428 rotates and does not rotate separately about the first rod 428. The term "gear" as used herein means a wheel rimmed with teeth or cogs along its circumference that mesh with or engage the teeth or cogs of another gear for transferring, passing, or transmitting rotational motion. The first gear 438 is important because its actuation initiates and causes the bubble generator assembly 30 to generate bubbles, as described in greater detail hereinbelow. To facilitate the actuation of the first gear 438, the teeth 333 of the rail portion 330 of the pump handle 22 (see FIG. 5A) engages the teeth of the first gear 438 to impart rotational movement to the first gear 438.

The first gear system further includes a second rod 448 having a second end 450*b* and a first end 450*a* that is rotatably secured to the second rod support 422. A second gear 452 is fixably mounted on the second rod 448. The second gear 452 has a large gear portion 460 and a small gear portion 456 integral therewith and extending from one side of the second gear 452 for engaging the first gear 438.

A third gear 464 is rotatably mounted on the first rod 428. "Rotatably mounted" means that the third gear 464 rotates separately about the first rod 428. The third gear 464 has a large gear portion 474 and a small gear portion 470 integral therewith and extending from one side of the third gear 464 for engaging the large gear portion 460 of the second gear 452. This is best illustrated in FIGS. 5B and 5G, with FIG. 5A presenting an expanded view showing the first and third gears 438 and 464 spaced apart from each other.

A fourth gear 482 is rotatably mounted on the second rod 448. The fourth gear 482 includes a small gear portion 486 for engaging the large gear portion 474 of third gear 464. In addition, the fourth gear 482 has a fan assembly 490 having a wall 492. The small gear portion 486 is integrally provided on one side of the wall 492, and a plurality of blades 494 are integrally provided on the other side of the wall 492 for creating an air flow or current.

Referring to FIG. 5G, bubble generator assembly 30 includes an air chamber 500 for housing the fan assembly 490 and an air conduit 504 for communicating air generated by the fan assembly 490 in the air chamber 500 to a bubble forming plate 560 described hereinbelow. The air chamber 500 includes a left side wall 502 that has a rod support 503 in which the second end 450*b* of the second rod 448 is rotatably secured.

The first gear 438, the second gear 452, the third gear 464 and the fourth gear 482 and its fan assembly 490, which make up the first gear system, are all disposed in planes that are generally parallel to each other. Therefore, rotation of the first gear 438 imparts rotation to the small gear portion 456 of the second gear 452, causing its large gear portion 460 to rotate, which in turn imparts rotation to the small gear portion 470 of the third gear 464, causing its large gear portion 474 to rotate, which in turn imparts rotation to the gear portion 486 of the fourth gear 482, causing its fan assembly 490 to rotate to generate blown air or air current. In this regard, the third and fourth gears 464 and 482 are not fixedly mounted to the first and second rods 428, 448, respectively, to facilitate this described gear action.

The second gear system will now be described in connection with FIG. 5G. The second gear system includes a fifth gear 520 that is fixably mounted on the first rod 428 adjacent the second end 432*b* in a plane that is generally parallel with the planes of the first, second and third gears 438, 452 and 464. A third rod 524 extends generally longitudinally along the length of bubble generator assembly 30 (i.e., in the same general plane as the first, second and third gears 438, 452 and 464) and is generally perpendicular to the first rod 428 and the second rod 448. The third rod 524 is supported by protruding supports 525 extending from the left side wall 502 of the air chamber 500 and the air conduit 504, and has a first end 526 and a second end 528.

Figure 5F:
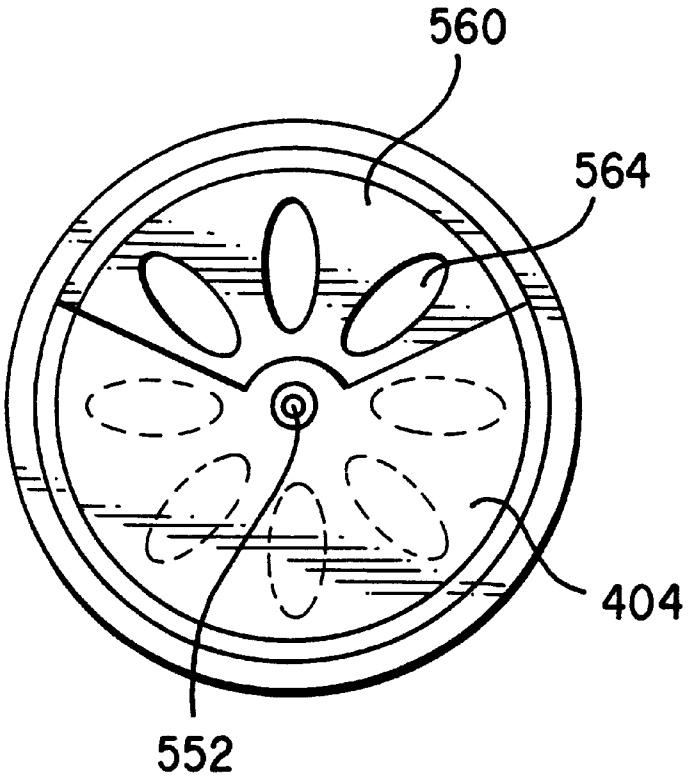
FIG. 5F is a front plan view illustrating in greater detail the bubble generation assembly of FIG. 5E.
Figure 5G:
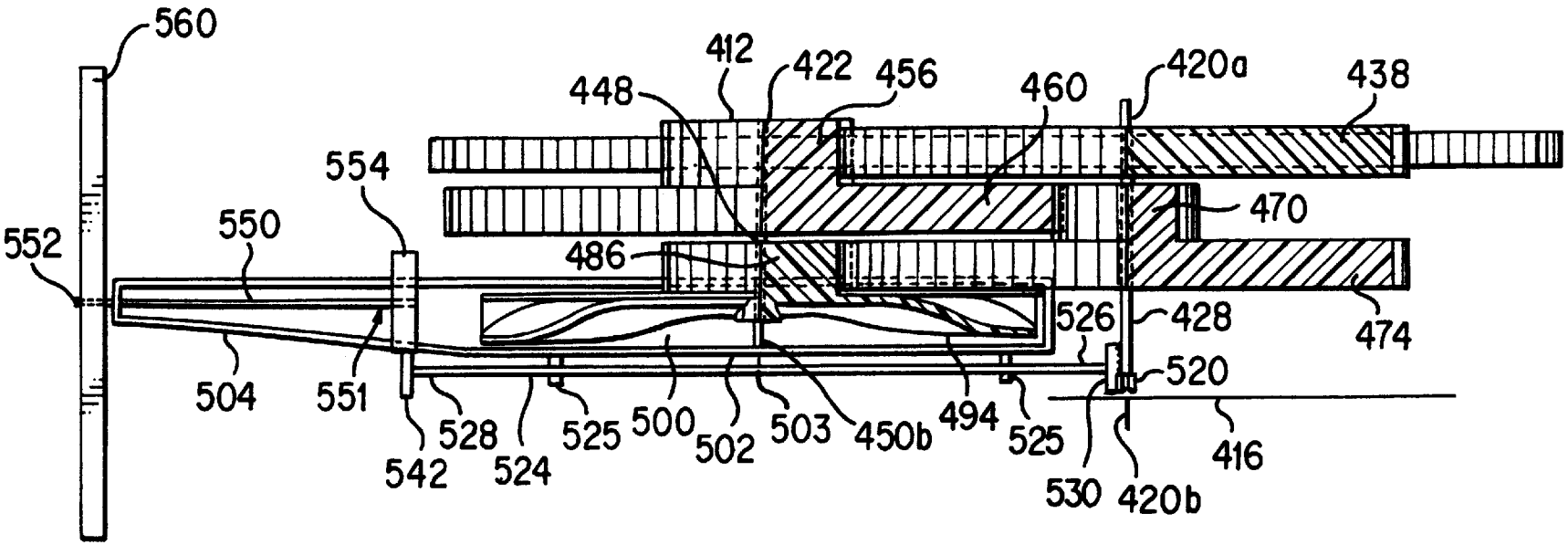
FIG. 5G is a partial cross-sectional top plan view illustrating in greater detail the bubble generator assembly of FIG. 1B.
Figure 5H:
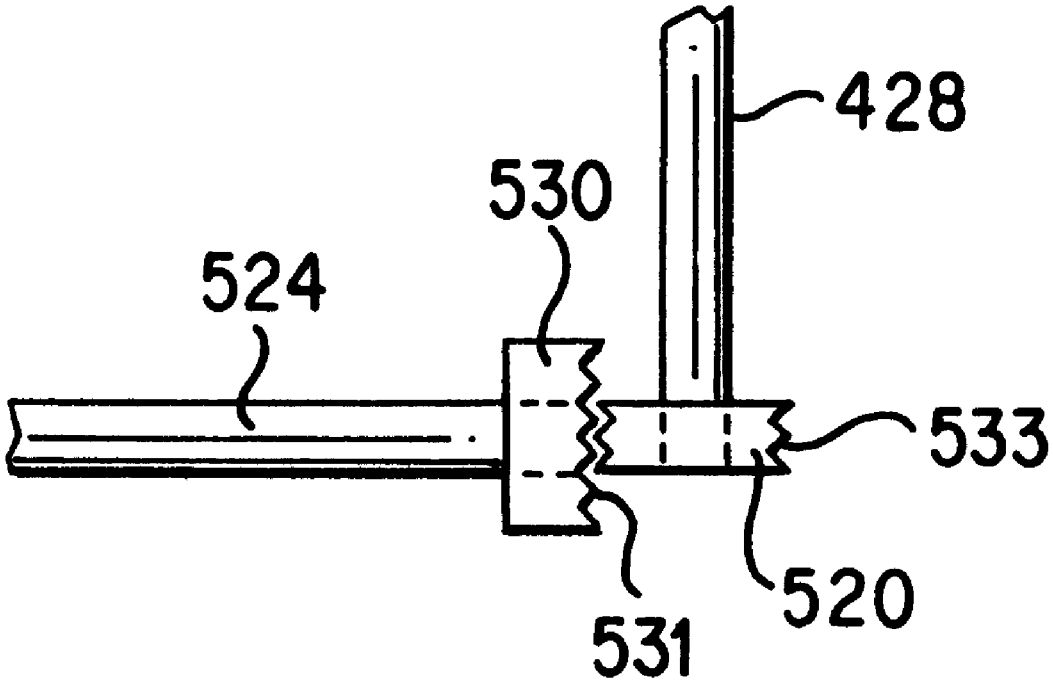
FIG. 5H is a partial cross-sectional view of the fifth and sixth gears illustrated in FIG. 5G.

Referring to FIG. 5H, a sixth gear 530 is fixably mounted at the first end 526 of the third rod 524, and has teeth 531 provided on its front surface for engaging the circumferential teeth 533 of the fifth gear 520. In addition, a seventh gear 542 is fixably mounted at the second end 528 of the third rod 524. The sixth and seventh gears 530 and 542 are positioned in planes that are generally parallel to each other. Thus, rotation of the fifth gear 520 and sixth gear 530 translates the rotational motion about transverse first rod 428 into rotational motion about longitudinal third rod 524, causing the sixth and seventh gears 530 and 542 to rotate at the same time.

A fourth rod 550 extends generally longitudinally along the length of bubble generator assembly 30 and is generally parallel to the third rod 524. The fourth rod 550 includes a first end 551 and a second end 552 that is rotatably secured at the rod support 408 of the front wall 404 (see FIG. 5E). The rod support 410 of the back wall 409 of the bubble solution container 407 also supports the fourth rod 550 adjacent its first end 551. An eighth gear 554 is fixably mounted on the fourth rod 550 at the first end 551 and rotatably engages the seventh gear 542. The seventh and eighth gears 542 and 554 are disposed in the same plane.

Referring now to FIG. 5F, a bubble forming plate 560 is fixably mounted on the fourth rod 550 proximal of the front wall 404 adjacent the second end 552, and is adapted to rotate when the fourth rod 550 rotates. The bubble forming plate 560 defines a plurality of openings 564, each having a generally tear-drop shape. Rotation of the bubble forming plate 560 causes the generation of bubbles when an opening 564 passes in front of the mouth of the air conduit 504 and the retained bubble solution is exposed to blown air. Thus, rotation of the first gear 438 causes the first rod 428 to rotate. This in turn causes the fifth gear 520 to rotate, thereby translating the rotation to the third rod 524 via the sixth gear 530. The rotation of the third rod 524 is translated to the fourth rod 550 via the rotational engagement of the seventh and eighth gears 542 and 554. Rotation of the fourth rod 550 then causes the bubble forming plate 560 to rotate. It is noted that the rotation of the first gear 438 also causes, simultaneously, the fan assembly 490 to generate an air current, as described above. Thus, the rotation of the first gear 438 simultaneously generates both an air current (via the first gear system) and causes the bubble forming plate 560 to rotate (via the second gear system), the combined action of which operates to generate bubbles that are released into the environment via the openings 564.

The bubble generator assembly 30 is designed so that the first gear system illustrated above can only be rotated in one direction, and not in both directions. This is an important feature, since the pump handle 22 is used to accomplish the dual functions of generating air pressure and generating bubbles. Pulling the pump handle 22 back and forth (i.e., reciprocation) is required to generate air pressure, but this reciprocating movement may also cause bubble solution from the bubble solution container 407 to be undesirably back-flowed into conduit 504 and back into the chamber 500 that houses the fan assembly 490. Therefore, the second gear 452 is configured to only allow rotation in one direction, and to disengage its rotatable coupling with the first gear 438 to prevent rotation in the opposite direction.

This is accomplished by providing the second gear 452, and in particular, the small gear portion 456, with a generally oval-shaped bore 454 having an engaging surface 457 and a generally opposite disengaging surface 458, which are shown in greater detail in FIGS. 5C and 5D. Referring first to FIG. 5C, when the pump handle 22 is moved in a first direction (see arrow FD in FIG. 5C) towards the nozzle assembly 26, the teeth of the first gear 438 will continually engage the teeth of the small gear portion 456 of second gear 452. This is due to the fact that gravity will cause the second gear 452 to descend closer towards the first gear 438, so that the second rod 448 abuts against the engaging surface 457. In this regard, the engaging surface 457 is further away from the first gear 438 than the disengaging surface 458 because of the oval shape of the bore 454. In addition, the rotation of the first gear 438 in the clockwise direction (see arrow CW in FIG. 5C) also creates a downward force on the first gear 438. Thus, the first and second gears 438 and 452 are in effect being brought closer together, thereby causing the teeth on both gears 438 and 452 to mesh, as shown in FIG. 5C.

On the other hand, referring now to FIG. 5D, when the pump handle 22 is moved in a second opposite direction (see arrow SD in FIG. 5D) towards nozzle assembly 26, the teeth of the first gear 438 disengages the teeth of the small gear portion 456 of second gear 452. This is due to the fact that the counterclockwise rotation (see arrow CCW in FIG. 5D) of the first gear 438 will impart upward forces to both gears 438 and 452 that urge the second rod 448 against the disengaging surface 458 and in effect causing the gears 438 and 452 to be distanced from each other, as shown in FIG. 5D. As a result, counterclockwise rotation of the first gear 438 will not result in any rotation by the second gear 452. Subsequent clockwise rotation of the first gear 438 will again cause the gears 438 and 452 to be brought closer to each other, thereby causing the engagement of the teeth of both gears 438 and 452 that actuates the first gear system again.

5. Operation

The operation of the toy gun 10 will now be described. First, a user fills the water container 12 with water. This can be done by pouring water through the inlet port 69. The inlet port 69 could have a lid (not shown) for covering it, in which case the user would remove the lid to pour the water therethrough. Second, the user fills the bubble solution container 407 with bubble solution via an inlet port 403 (see FIG. 5E) in the housing 400. The toy gun 10 is now ready for use.

The operation of the toy gun 10 includes the generation of bubbles that act as targets for the water or ammunition fired from the toy gun 10. The user can simultaneously generate bubbles and pressurize the water container 12 by reciprocating the pump handle 22. As described above, reciprocating the pump handle 22 introduces air pressure into the water container 12 via the valve assembly 344 to force water from the water container 12 through the water tube 150 and the upper conduit 100. At the same time, the reciprocation of the pump handle 22 reciprocates the sliding movement of the rail 330 which causes the first gear 438 engaged thereto to rotate, thereby simultaneously actuating the first gear system to generate an air current and the second gear system to rotate the bubble forming plate 560, so as to generate bubbles. As noted above, when pump handle 22 is moved in the direction of arrow SD of FIG. 5D, the rail 330 still rotates the first gear 438. However, since the first gear 438 disengages from the second gear 452, the rotation of the first gear 438 is not translated to the fourth gear 482, so no air is fanned or provided to bubble forming plate 560, and therefore no bubbles are generated.

After reciprocating the pump handle 22 several times, targets in the form of bubbles will have been generated, and the water in water container 12 will have been pressurized. Once pressurized, the water gun 10 is ready to be aimed and fired. To fire the water gun 10, the user presses the trigger 18. When pressed by the user, the trigger 18 overcomes the natural bias of the spring 205 and compresses the spring 205, pulling the stopper 144 rearwardly into an open position that allows pressurized water to enter the lower conduit 120 from the upper conduit 100, and to exit water gun 10 through the channel 135 in the nozzle head 134.

Thus, the present invention provides a toy gun 10 having a compact and efficient design which allows both a target (such as water) to be generated and fired at by an ammunition (such as water) at the same time. This provides variety in play and entertainment, and provides harmless targets that can be fired at, thereby minimizing harm to humans and other objects.

Although the toy water gun 10 is illustrated as employing water for its ammunition, those skilled in the art will appreciate that other forms of ammunition, such as foam or plastic bullets or darts, can be employed without departing from the scope of the present invention. In such cases, the toy gun 10 can be modified to include another ammunition generation assembly that generates, produces or fires the ammunition (such as a foam or plastic bullet or dart, among others). Similarly, instead of bubbles, other targets (such as foam objects, discs, or other objects) can be generated or produced. In such cases, the bubble generation assembly 30 can be replaced by an appropriate target generation assembly.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A toy water gun for firing water comprising:

a container for storing water;

a bubble generator for generating bubbles, said bubble generator having a first gear;

a trigger assembly for allowing a user to selectively fire water from the water gun; and a pump handle adapted to be moved by a user in a first direction and a second direction, the pump handle having an external surface and an engagement portion, said engagement portion forming a plurality of teeth, for activating the first gear when the pump handle is moved in the first direction and for disengaging from the first gear when the plunger is moved in the second direction;

wherein the movement of the pump handle in the first direction simultaneously pumps air into said water container and activates the bubble generator.

2. The toy water gun of claim 1, wherein the bubble generator includes a rod, a second gear rotatably mounted on the rod, said second gear defining a mount portion, said mount portion having an engaged surface and a disengaged surface, said first gear engaging the second gear and said rod in contact with said engaged surface when the pump handle is moved in the first direction, said first gear disengaged from the second gear and said rod in contact with said disengaged surface when the pump handle is moved in the second direction.

3. The toy water gun of claim 2, wherein the bubble generator includes:

a third gear coupled to the second gear;

a fourth gear coupled to the third gear, said fourth gear having a fan portion that defines a plurality of blades;

an air chamber for housing the fan portion of the fourth gear; and an air conduit for transporting air.

4. The toy water gun of claim 3, further comprising a longitudinal rod, and a bubble forming plate fixedly mounted on the longitudinal rod, said air conduit having one end proximal to the bubble forming plate.

5. The toy water gun of claim 1, wherein the mount portion has a generally oval cross-section.

6. The toy water gun of claim 1, wherein the bubble generator includes a receptacle for storing bubble solution.

7. A toy water gun for firing water comprising:

a first container for storing ammunition;

a target generator for generating a target;

a trigger assembly for allowing a user to selectively fire the ammunition; and an actuator coupled to the first container and the target generator for generating the target and for preparing the ammunition for firing.

8. The apparatus of claim 7, wherein the ammunition is a fluid, and the target generator is a bubble generator that generates bubbles.

9. The apparatus of claim 8, wherein:

the bubble generator has a first gear;

the actuator is a pump handle adapted to be moved by a user in opposing first and second directions, the pump handle having an external surface and an engagement portion forming a plurality of teeth for activating the first gear when the pump handle is moved in the first direction; and wherein the movement of the pump handle in the first direction simultaneously pumps air into the container and activates the bubble generator.

10. The apparatus of claim 9, wherein the engagement portion disengages from the first gear when the pump handle is moved in the second direction.

11. The apparatus of claim 9, wherein the bubble generator includes a rod, a second gear rotatably mounted on the rod, said second gear defining a mount portion, said mount portion having an engaged surface and a disengaged surface, said first gear engaging the second gear and said rod in contact with said engaged surface when the pump handle is moved in the first direction, said first gear disengaged from the second gear and said rod in contact with said disengaged surface when the pump handle is moved in the second direction.

12. The apparatus of claim 11, wherein the mount portion has a generally oval cross-section.

13. The apparatus of claim 11, wherein the bubble generator includes:

a third gear coupled to the second gear;

a fourth gear coupled to the third gear, said fourth gear having a fan portion that defines a plurality of blades;

an air chamber for housing the fan portion of the fourth gear; and an air conduit for transporting air.

14. The apparatus of claim 13, further comprising a longitudinal rod, and a bubble forming plate fixedly mounted on the longitudinal rod, the air conduit having one end proximal to the bubble forming plate.

15. The apparatus of claim 8, wherein the bubble generator includes a receptacle for storing bubble solution.

16. The apparatus of claim 8, further including a nozzle and a fluid conduit coupling the container to the nozzle.

17. The apparatus of claim 16, wherein the trigger assembly has a stopper that is positioned to block the fluid conduit.

18. The apparatus of claim 8, further including means coupled to the actuator for generating and providing air pressure to the container.

19. The apparatus of claim 18, further including means provided between the actuator and the container for preventing backflow of air or fluid to the actuator.

* * * * *